US005468915A

United States Patent [19]

Green

[11] Patent Number: 5,468,915

[45] Date of Patent: Nov. 21, 1995

[54] STRIPPABLE FIBERGLASS INSULATED CONDUCTOR

[76] Inventor: Edward A. Green, 4419 State Rte. 82, Mantua, Ohio 44255

[21] Appl. No.: 36,382

[22] Filed: Mar. 24, 1993

[51] Int. Cl.[6] ..... H01B 7/00

[52] U.S. Cl. ..... 174/124 R; 156/56

[58] Field of Search ..... 174/124 R, 124 G, 174/124 GC, 122 R, 122 G, 122 C, 121 R, 121 SR; 156/47, 51, 53, 56

[56] References Cited

U.S. PATENT DOCUMENTS

| | | | |
|---|---|---|---|
| 2,048,886 | 7/1936 | Olson | 174/124 R |
| 3,480,725 | 11/1969 | Mildner | 174/124 R |
| 3,629,024 | 12/1971 | Kimura et al. | 156/56 |
| 3,694,565 | 9/1972 | Ash | 174/117 R |
| 3,845,438 | 10/1974 | Mendelsohn et al. | 336/209 |
| 4,051,324 | 9/1977 | Anderson et al. | 174/121 R |
| 4,408,088 | 10/1983 | Foote | 136/226 |
| 4,600,634 | 7/1986 | Langer | 428/220 |
| 5,154,954 | 10/1992 | Crood | 428/34.5 |
| 5,274,196 | 12/1993 | Weinberg | 174/121 R |

*Primary Examiner*—Morris H. Nimmo
*Assistant Examiner*—Christopher Horgan
*Attorney, Agent, or Firm*—Albert E. Chrow

[57] ABSTRACT

A fiberglass insulated conductor referenced by numeral (100) is provided for which at least one fiberglass layer (6') in close proximity to the electrical conductor (2) has been treated with a solution operative upon heat aging to render the treated fibers sufficiently frangible to break and eliminate stringing during the process of stripping the fiberglass from conductor (2). Another embodiment referenced by numeral (300) illustrates that one or both an electrically insulative tape or extruded layer (38) may be disposed intermediate the electrical conductor (36) and a surrounding fiberglass layer (40).

16 Claims, 2 Drawing Sheets

STRIPPABLE FIBERGLASS INSULATED CONDUCTOR

INTRODUCTION

This invention relates generally to electrical conductors encompassed by at least one layer of fiberglass to provide high temperature operating capability and more particularly to fiberglass insulated conductors for which at least the fiberglass in close proximity to the conductor is treated with a solution operative to render the fibers sufficiently frangible upon heat aging to enhance the strippability of the fiberglass from the conductor.

BACKGROUND OF THE INVENTION

Fiberglass has been used for many years in high temperature resistant electrical wire and cable constructions. Fiberglass has the advantages of being an enorganic material having a softening point above 800° C. and yet is flexible in filament, yarn strands or fiber form and also in the form of woven or braided cloth, tapes or sleeves and the like such as disclosed in U.S. Pat. No. 5,154,954, the disclosure of which is incorporated herein by reference.

It has also been the practice to impregnate fiberglass electrical insulation with high temperature binders, varnishes, and resins of various kinds and types that in many cases tend to lower the softening point to less than 200° C. and also characteristically tend to stiffen the insulated conductor or cable.

In some instances, high temperature resistant electrical insulation combine mica and fiberglass to provide resistance to temperatures of 450° C. or higher such as disclosed in U.S. Pat. No. 3,629,024, the disclosure of which is incorporated herein by reference and in which mica is bonded to a fiberglass backing by a relatively hard and nonpliable resinous composition.

An example of a high temperature insulation system for electrical wire and cable products rated at 250° C. is where the wire or conductor is provided with a taped or ram extruded coating of polytetrafluorelylene (PTFE) polymer about which a layer of fiberglass yarn is wrapped or served which is then enclosed by a fiberglass braid.

Thus, numerous high temperature products, including electrical wire and cable products, have been developed over the years using fiberglass, or impregnated fiberglass, or combinations of fiberglass with other inorganic materials such as mica.

One of the problems associated with fiberglass electrical insulation however, is that there is a tendency for the fiberglass fibers in close proximity to the conductor to string out and not break cleanly when the fiberglass is being cut through in order to strip the fiberglass from the conductor for making an electrical connection or the like.

One of the reasons contributing to the stringing tendency of the fiberglass fibers is that cutting blades are often sized so as not to contact the conductor itself, for fear of damaging the conductor, and thus may only partially cut through the last few remaining fibers of fiberglass in close proximity to the conductor causing the stripping process to be more costly and time consuming by having to remove the fiber strings separately.

It has been discovered that the stringing tendency of fiberglass fibers in close proximity to an electrical conductor from which the insulation is being stripped can be virtually eliminated and thus the strippability enhanced by treating fibers with a solution operative to render them sufficiently frangible upon heat aging to enhance the strippability of the fiberglass from the conductor of which our example has been found to be a solution containing sodium silicate.

SUMMARY OF THE INVENTION

Accordingly, it is an object of this invention to provide an electrical conductor having at least one layer of fiberglass insulation.

It is another object of this invention to provide an electrical conductor having at least one layer of fiberglass in close encompassing relationship to the conductor that is provided ,with enhanced strippability therefrom.

It is still another object of this invention to provide a method for making an electrical conductor having a layer of fiberglass in close encompassing relationship to the conductor that is provided with enhanced strippability therefrom by treating the fibers with a solution operative to render the fibers frangible upon heat aging.

DESCRIPTION OF SOME PREFERRED EMBODIMENTS

Figure 1:
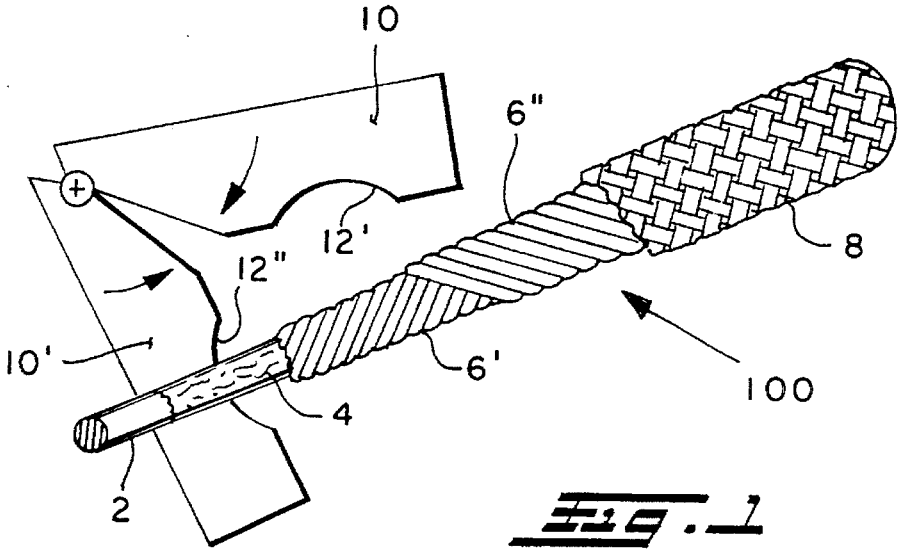
FIG. 1 is a perspective view of an insulated electrical conductor referenced by numeral 100 made in accordance with the invention.

Insulated electrical conductor 100 in FIG. 1 illustrates but one of the numerous ways by which fiberglass can be used to provide a high temperature resistant insulation about an electrical conductor referenced by numeral 2. Conductor 2 is made from a high electrically conductive metal such as copper or other metal or metal combinations or certain non-metals such as carbon or graphite filed materials well known to those skilled in the art of electrical wire and cable construction.

Conductor 2 may be solid or comprise a plurality of stranded filaments depending on the intended use and flexibility desired.

Conductor 2 may be coated with a suitable release agent referenced by numeral 4 of which a teflon-based release agent sold under the trade name "McLube" has been found to be effective. The use of a release agent further enhances the ease by which the fiberglass can be stripped away from conductor 2.

A first spirally wrapped or served layer 6' of fiberglass fiber is disposed in close encompassing relationship to conductor 2. A second spiral layer 6" of fiberglass fiber is disposed at an oppositely wound angle about layer 6' which in turn is surrounded by a braided layer 8 of fiberglass to complete the construction which, as previously described, is but one of numerous ways by which to provide high temperature insulated electrical wire or cable utilizing fiberglass. Thus, the present invention, in its broadest sense, only requires that a layer of fiberglass be in close proximity to the conductor and other materials, including fiberglass, may be employed outwardly of the inner fiberglass layer dependent upon the performance characteristics desired and also inwardly such as mica tape or teflon tape or extruded teflon that are wrapped or extruded about the conductor beneath the fiberglass layer and are relatively thin such as, for example, less than 15 mils in thickness and, as such, may be subject to damage upon cutting completely through the fiberglass layer during the stripping process.

The fiberglass in layer 6' has been treated with a solution operative to render the fibers sufficiently frangible upon heat aging containing sodium silicate to enhance the strippability of the fibers of fiberglass from the conductor. One such solution has been found to be a solution containing sodium silicate as hereinafter described. Such is illustrated by the pair of pivotally mounted cutting blades 10 and 10' having respective cutter edges 12 and 12' that, when closed about insulated conductor 100, cut through the fiberglass layers but not to the extent of cutting or damaging conductor 2 and since the fiberglass fibers in close proximity to the conductor have been rendered frangible according to the invention, and have broken during the stripping process and are not left as stringers requiring separate removal.

The fiberglass in layer 6' has been treated with a solution containing sodium silicate (which is known as water glass) and is represented by the formula $Na_2O(x)SiO_2$ where (x) can range from 2 to 4. Sodium silicate has an amorphous structure and is soluble in water up to 55 parts by weight to 100 parts by weight water or even higher. In some instances, it is found in combined form with potassium silicate (double water glass) and, when dissolved in water, tends to make a viscous syrupy liquid. It has heretofore been known to be used in cement, for protective coatings, as a fixing agent for dyes, and for hardening surgical dressings.

Although other carriers may be employed, it is preferred to treat the fiberglass with a aqueous solution of sodium silicate. Although other concentrations may be used for aqueous solutions, a particularly preferred aqueous solution ratio for treating fiberglass is about four parts by volume of sodium silicate to about one part by volume of water.

The sodium silicate appears to react in some manner with fiberglass upon exposure to heat to render the treated fibers sufficiently frangible to break and thus eliminate stringing during the stripping process.

As used herein, the term "heat age" means any combination of time and temperature effective to render the treated fibers sufficiently frangible to break and eliminate stringing during the stripping process. The heat aging may be conducted either in a continuous or batch type operation in an oven or the like, or both. One combination of time and temperature found to be particularly effective is to heat the insulated connector having the treated fibers at a temperature of about 600° F. for about one and one-half minutes.

Figure 2:
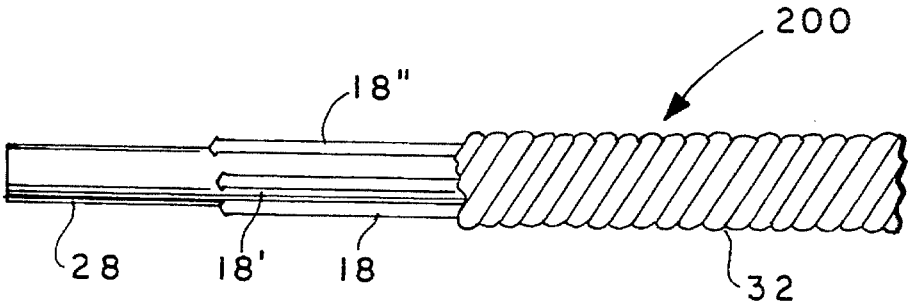
FIG. 2 is a side elevation view of an insulated electrical conductor referenced by numeral 200 made in accordance with the invention.
Figure 4:
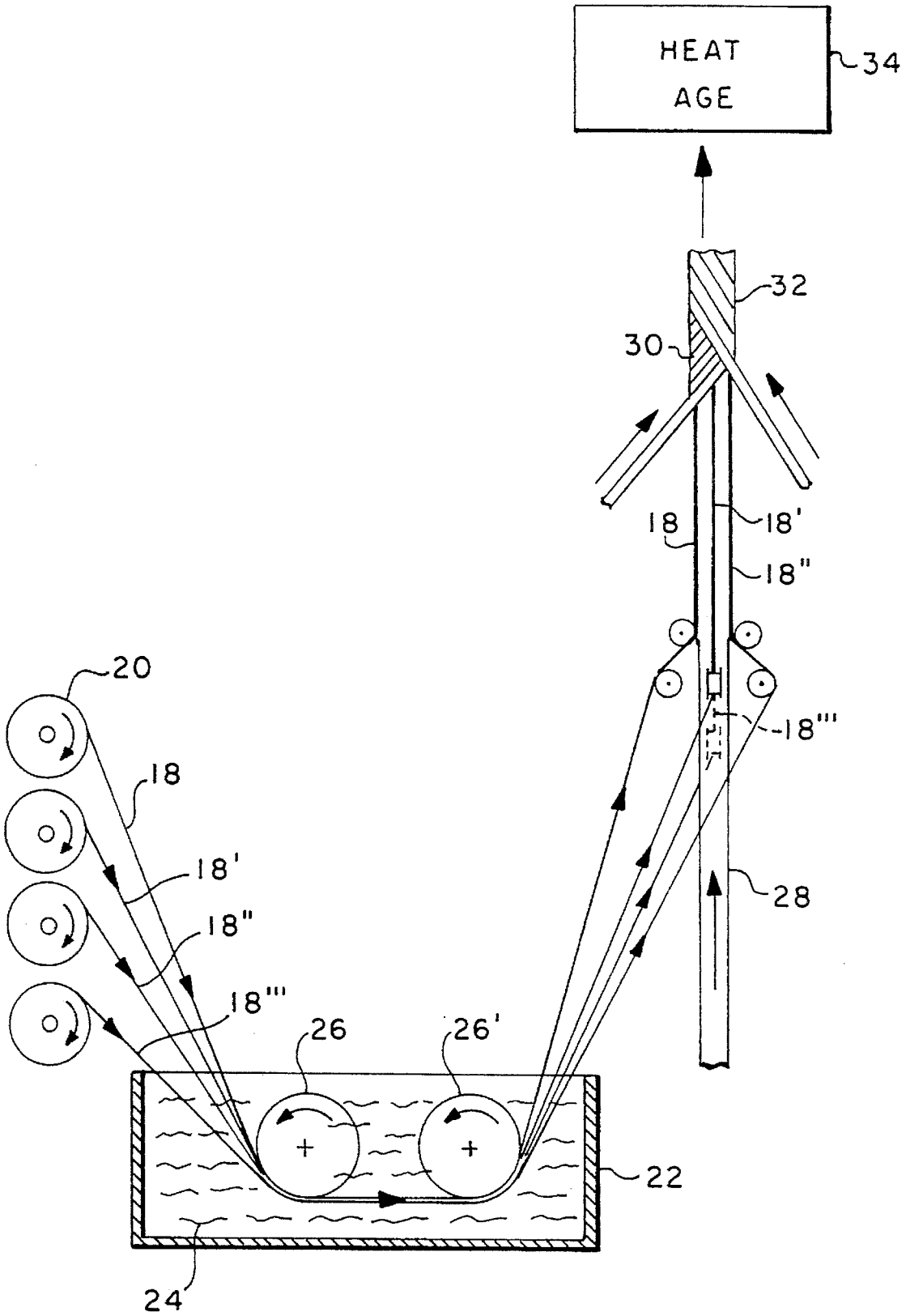
FIG. 4 is a schematic side view of one method by which to make the insulated electrical conductor 200 of FIG. 2.

Another form of a fiberglass insulated connector 200 is shown in FIG. 2 and one method by which it can be made is shown in FIG. 4.

In FIG. 2, insulated electrical conductor 200 has a conductor 28 along which are disposed a plurality of circumferentially spaced-apart fiberglass strands referenced by numerals 18, 18' and 18''' respectively. An additional fiberglass strand, referenced by numeral 18''' in FIG. 4, is disposed on the back side of conductor 28 in FIG. 2.

Fiberglass strands 18, 18', 18'' and 18''' have been treated with an aqueous solution of sodium silicate and then heat aged to accelerate the reaction to eliminate the stringing tendency of the fiberglass in close proximity to the conductor during the stripping process. The longitudinally extending fibrous strands are in turn surrounded by a pair of oppositely wound spiral layers of fiberglass with the outermost referenced by numeral 32.

Figure 3:
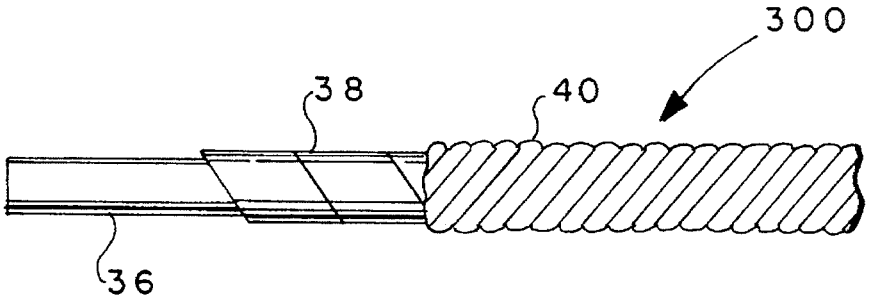
FIG. 3 is a side elevation view of an insulated electrical conductor referenced by numeral 300 made in accordance with the invention.

Fiberglass strands 18, 18', 18'' and 18''' are operative to transfer the aqueous silicate solution to the adjacent surrounding spirally wrapped fiberglass referenced by numeral 30 in FIG. 3 and hidden beneath fiberglass wrap 32 in FIG. 2. Fibrous strands 18, 18' and 18'' are shown as remaining on conductor 28 in FIG. 2 only for illustrative purposes for having been treated and heat aged in accordance with the invention, they would have broken away from the conductor during the stripping process.

Another preferred embodiment of an insulated electrical conductor made in accordance with the invention is referenced by numeral 300 in FIG. 3.

In FIG. 3, a wrapping of high temperature resistant tape such as mica or teflon tape 38 is wound about electrical conductor 36 and is encompassed by a spirally wound layer of fiberglass referenced by numeral 40 that has been treated with an aqueous solution of sodium silicate and then preferably heat aged at an elevated temperature in accordance with the invention such that it has been rendered frangible and breaks rather than leaving strings during the process of stripping fiberglass 40 from the insulated conductor.

Insulation 300 illustrates the fact that the fiberglass layer need not be in direct contact with the conductor and may encompass relatively thin layers of extruded or tape insulation that might have otherwise been damaged had fiberglass 40 not been frangible and broken away easily during the stripping process.

One method of making fiberglass insulated conductors in accordance with the present invention is shown in FIG. 4 in which a plurality of fiberglass strands 18, 18', 18'' and 18''' are un-reeled from spools 20 ( only one referenced) and pass through bath or tank 22 containing the aqueous silicate solution described herein and thence by means of guide rollers and the like are disposed in longitudinally extending circumferentially spaced-apart relationship about conductor 28 afterwhich the oppositely bound spirally wrapped layers 30 and 32 are spiraled about the longitudinally treated fiberglass strands which are operative to transfer the aqueous silicate solution to at least the innermost fibers of layer 30. The spiral wound conductor is then heat aged in an oven or other suitable medium referenced by numeral 34 to render the treated fibers sufficiently frangible to enhance the strippability of the fiberglass from conductor 28. Alternately, the solution containing sodium silicate may itself be heated (to a temperature below the boiling point of water in the case of an aqueous solution) and various combinations of time and temperature may be employed between heating the solution and/or heating the fibers separately either in a continuous or batch type operation after having been treated with the solution containing sodium silicate.

What is claimed is:

1. An electrical conductor having at least one layer of fiberglass in close proximity thereto that has been treated with a solution operative to render the fiberglass sufficiently frangible upon heat aging to enhance the strippability of the fiberglass from the conductor.

2. The conductor of claim 1 wherein the solution contains sodium silicate.

3. The conductor of claim 1 having a release coating thereon to further enhance the strippability of the fiberglass from the conductor.

4. The conductor of claim 1 having an electrically insulative tape layer disposed intermediate the conductor and the fiberglass layer.

5. The conductor of claim 1 having an extruded electrically insulative layer disposed intermediate the conductor and the fiberglass layer.

6. The conductor of claim 1 having both an electrically insulative tape layer and an electrically insulative extruded layer disposed intermediate the conductor and the fiberglass layer.

7. The conductor of claim 1 wherein the treated fiberglass is heat aged at a temperature of at least about 600° F. for at least about one and one-half minutes.

8. The conductor of claim 1 or 2 wherein the solution is an aqueous solution.

9. The conductor of claim 1 or 2 wherein the solution is a heated solution.

10. The conductor of claim 8 wherein the aqueous solution is a heated aqueous solution.

11. A method for improving the strippability of fiberglass in close proximity to an electrical conductor, said method including the steps of:

treating the fiberglass with a solution operative to render the fiberglass frangible upon heat aging; and then heat aging the treated fiberglass for a time and at a temperature operative to render the treated fiberglass sufficiently frangible to enhance the strippability of the fiberglass from the conductor.

12. The method of claim 11 wherein the solution contains sodium silicate.

13. The method of claim 11 or 12 wherein the solution is an aqueous solution.

14. The method of claim 11 including the step of coating the conductor with a release agent.

15. The method of claim 11 wherein the treated fiberglass comprises a plurality of circumferentially spaced-apart fiberglass strands that respectively extend longitudinally along the conductor and are operative to transfer the solution to a layer of fiberglass surrounding the strands.

16. The method of claim 11 wherein the treated fiberglass is heat aged at a temperature of at least about 600° F. and for a time of about one and one-half minutes.

* * * * *